US008403010B2

(12) United States Patent
Taniguchi et al.

(10) Patent No.: US 8,403,010 B2
(45) Date of Patent: Mar. 26, 2013

(54) TABLET FILLING DEVICE

(75) Inventors: Akira Taniguchi, Toyonaka (JP); Minoru Tano, Toyonaka (JP); Yoshinori Maeji, Toyonaka (JP)

(73) Assignee: Yuyama Mfg., Co., Ltd., Osaka (JP)

( * ) Notice: Subject to any disclaimer, the term of this patent is extended or adjusted under 35 U.S.C. 154(b) by 684 days.

(21) Appl. No.: 12/665,550

(22) PCT Filed: Jun. 18, 2008

(86) PCT No.: PCT/JP2008/061143

§ 371 (c)(1),
(2), (4) Date: Dec. 18, 2009

(87) PCT Pub. No.: WO2008/156111

PCT Pub. Date: Dec. 24, 2008

(65) Prior Publication Data

US 2010/0154928 A1 Jun. 24, 2010

(30) Foreign Application Priority Data

Jun. 21, 2007 (JP) ..... 2007-164049

(51) Int. Cl.
*B65B 43/42* (2006.01)

(52) U.S. Cl. ..... 141/171; 414/222.01; 221/254; 198/435; 198/457.03; 198/575; 198/607

(58) Field of Classification Search ..... 141/129, 141/171, 174; 414/222.01, 416.05, 416.06; 221/254, 257, 224; 198/412, 413, 435, 457.03, 198/575, 607

See application file for complete search history.

(56) References Cited

U.S. PATENT DOCUMENTS

| | | | | |
|---|---|---|---|---|
| 3,392,815 | A * | 7/1968 | Skeels, Sr. et al. | 198/388 |
| 4,027,458 | A * | 6/1977 | Goodman | 53/55 |
| 5,318,200 | A * | 6/1994 | Allen et al. | 221/192 |
| 6,119,737 | A * | 9/2000 | Yuyama et al. | 141/104 |
| 6,827,202 | B2 * | 12/2004 | Topmiller et al. | 198/781.05 |
| 7,228,955 | B2 * | 6/2007 | Comas Corral | 198/527 |
| 2002/0007868 | A1 * | 1/2002 | Kodama et al. | 141/104 |

FOREIGN PATENT DOCUMENTS

| | | | |
|---|---|---|---|
| JP | 11070901 | A | 3/1999 |
| JP | 2000185811 | A | 7/2000 |
| JP | 2002029511 | A | 1/2002 |
| JP | 2005040459 | A | 2/2005 |
| WO | WO 2007/032298 | A1 | 3/2007 |

OTHER PUBLICATIONS

Patent Office of The People's Republic of China, Notification of Second Office Action, Application No. 200880021084.X, mailed Nov. 29, 2012.

* cited by examiner

*Primary Examiner* — Gregory Huson
*Assistant Examiner* — Jason K Niesz
(74) *Attorney, Agent, or Firm* — Jones Day

(57) ABSTRACT

There is provided a tablet filling device, which can smoothly supply vials without any stop of the device even if the vials cause a jam within a stocker. The tablet filling device is related to removing a vial 9 from a stocker 21 accommodating a large number of vials 9 according to a prescription data, dispensing tablets into the vial 9 to fill the vial, and discharging the vial 9 filled with the tablets. The stocker 21 includes: a vial removing device 24 configured to scoop the vial 9 accommodated in the stocker 21 upward to remove the vial; and a vial conveying device 23 configured to convey the vial 9 toward the vial removing device 24. When a jam of the vial 9 occurs, the vial conveying device 23 is reversely driven.

4 Claims, 17 Drawing Sheets

TABLET FILLING DEVICE

CROSS REFERENCE TO RELATED APPLICATIONS

This application is a 35 U.S.C §371 national stage filling of International Application No. PCT/JP2008/061143, filed Jun. 18, 2008, the entire contents of which are incorporated by reference herein, which claims priority to Japanese Patent Application No. 2007-164049, filed Jun. 21, 2007, the entire contents of which are incorporated by reference herein.

TECHNICAL FIELD

The present invention relates to a tablet filling device for filling a vial with tablets, and more particularly to a stocker for vials thereof.

BACKGROUND ART

There exists in the art a tablet filling device configured to dispense tablets according to prescription data, fill a vial with the tablets, and discharge the vial filled with the tablets to an outlet. Such a tablet filling device is configured such that stockers accommodate a large number of vials according to their size. Further, when the prescription data arrives, the vials of a size suitable to a prescription of the prescription data are removed one by one.

For example, according to Patent Document 1 mentioned below, a conveyor with paddles attached thereto at regular intervals is vertically provided alongside an inner wall of a stocker, wherein the paddles scoop the vials upward to remove them. Further, a rotary disk with protrusions is provided on an inclined inner bottom of the stocker and orientation of the vials changes by regularly rotating the rotary disk, thereby facilitating the scooping of the vials by the paddles.

However, although such a rotary disk is regularly rotated, the vials interfere with the paddles in the stocker or the vial hanging on the paddle interferes with other vials existing therearound, thereby causing the so-called jam and failing to remove the vial.

When the jam occurs, it is necessary to stop the tablet filling device and manually mix or flatten the vials in the stocker. Accordingly, this creates problems in that the dispensation work is delayed and the patient waiting time is prolonged.

Patent Document 1: Japanese Patent Application Laid-Open No. 2002-29511

SUMMARY OF THE INVENTION

Thus, it is an object of the present invention to provide a tablet filling device, which allows vials to be smoothly supplied without any stop of the device even if the vials cause jam within a stocker.

In order to solve the foregoing problems, according to the present invention, there is provided a tablet filling device for removing a vial from a stocker accommodating a large number of vials according to a prescription data, dispensing tablets into the vial to fill the vial, and discharging the vial filled with the tablets. The stocker includes: a vial removing device configured to scoop the vial accommodated in the stocker upward to remove the vial; and a vial conveying device configured to convey the vial toward the vial removing device. When the vial jams, the vial conveying device is reversely driven.

According to such construction, if the vial conveying device is reversely driven when the vial is jammed, then a layer of the vials placed on the vial conveying device separates from the vial removing device to thereby resolve the jam.

Preferably, the vial removing device includes a belt conveyor wherein paddles are attached to an endless belt at regular intervals.

Further, the vial conveying device preferably includes a belt conveyor and is inclined upward toward the vial removing device. Since the vial conveying device is inclined upward toward the vial removing device, when the vial conveying device is reversely driven, the layer of the vials on the vial conveying device can easily separate from the paddle of the vial removing device to thereby resolve the jam of the vial.

Preferably, the stocker further includes a guide plate, which is configured to guide the vial conveyed by the vial conveying device to the paddle of the vial removing device, between a front end of the vial conveying device and a lower end of the vial removing device. The guide plate guides the vial to the paddle, thereby facilitating removal of the vial.

Preferably, the stocker also includes a jam detecting means configured to detect the jam of the vial. A component that detects an increase of torque (electrical current), a drive amount, a drive failure or the like during drive of the vial removing device may be employed as the jam detecting means.

Preferably, the stocker further includes a means configured to detect overfilling of the vial in the stocker. Since overfilling of the vial may cause the jam, detecting the overfilling and appropriately indicating it can resolve the overfilling and prevent the jam occurrence.

According to the present invention, the stocker includes: the vial removing device configured to scoop the vial accommodated in the stocker upward to remove the vial; and the vial conveying device configured to convey the vial toward the vial removing device. Further, when the jam of the vial occurs, the vial conveying device is reversely driven. Thus, the layer of the vial placed on the vial conveying device is allowed to separate from the vial removing device to thereby settle the jam. Accordingly, the vial can be smoothly supplied without any stop of the tablet filling device.

DESCRIPTION OF REFERENCE NUMERALS

1 . . . Tablet filling device
9 . . . Vial
21 . . . Stocker
23 . . . Conveyor
24 . . . Removing device
25 . . . Paddle
26 . . . Guide plate
29*b* . . . Overfill sensor

DETAILED DESCRIPTION

Figure 1:
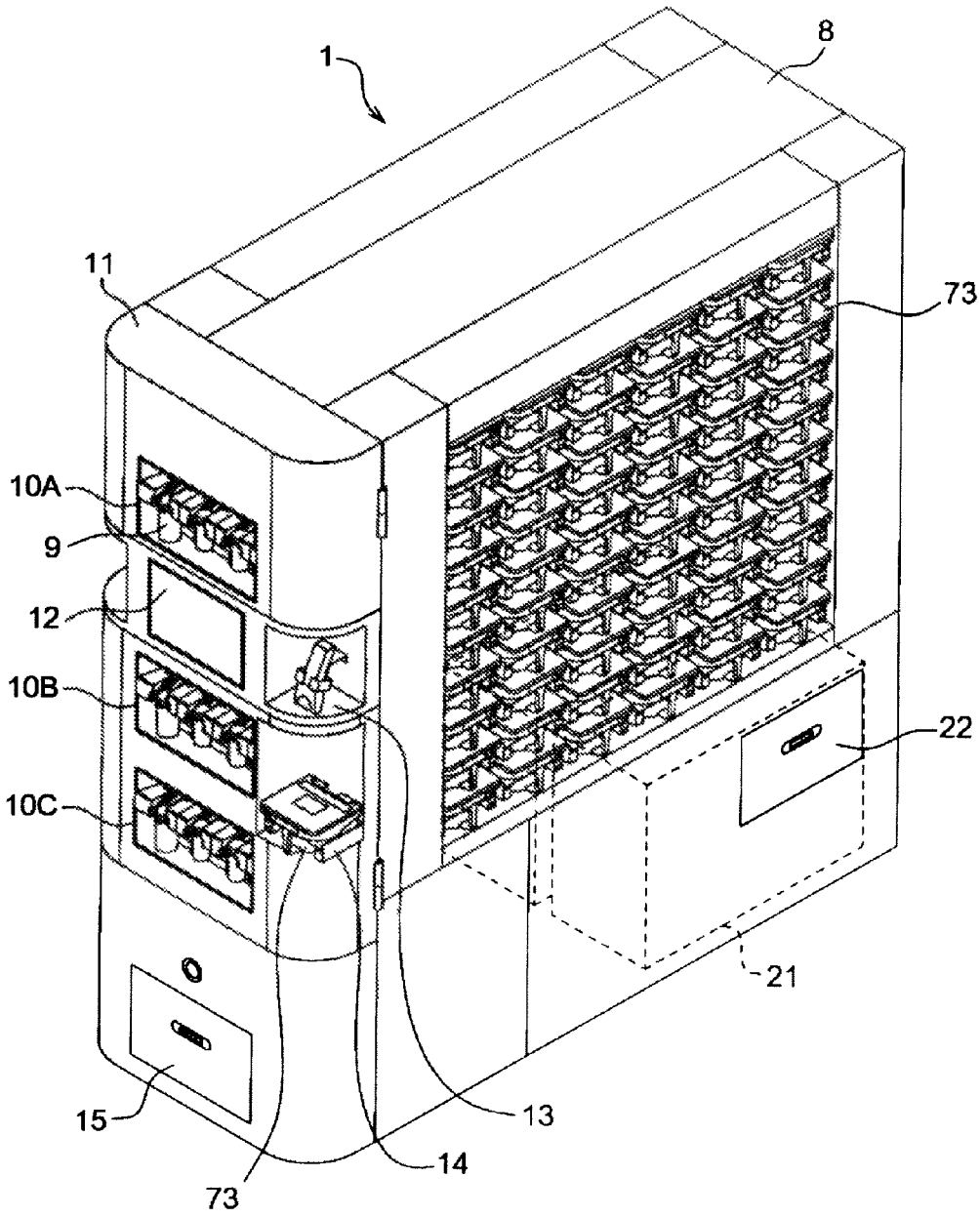
FIG. 1 is a perspective view of a tablet filling device according to the present invention.
Figure 2:
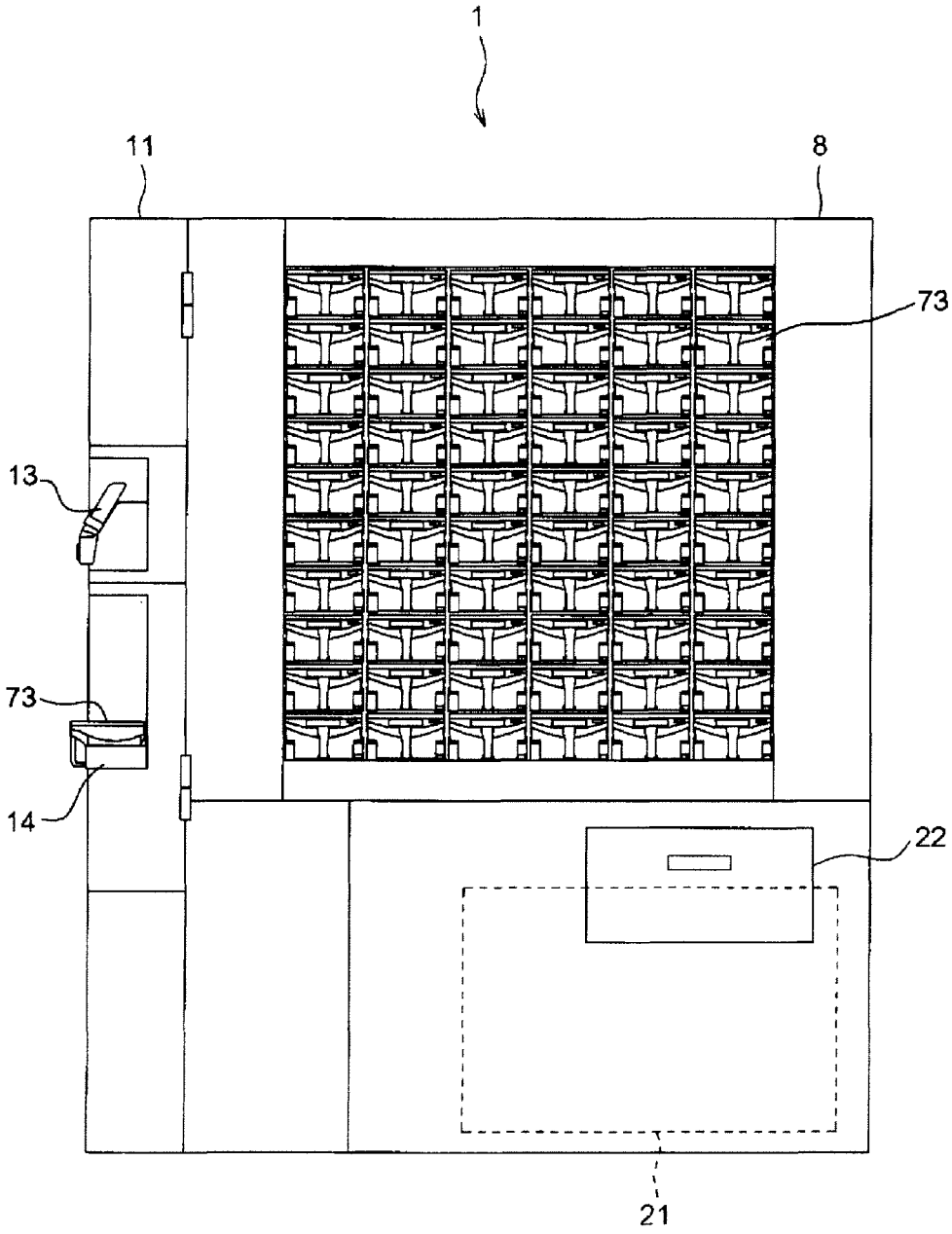
FIG. 2 is a side view of the tablet filling device shown in FIG. 1.
Figure 3:
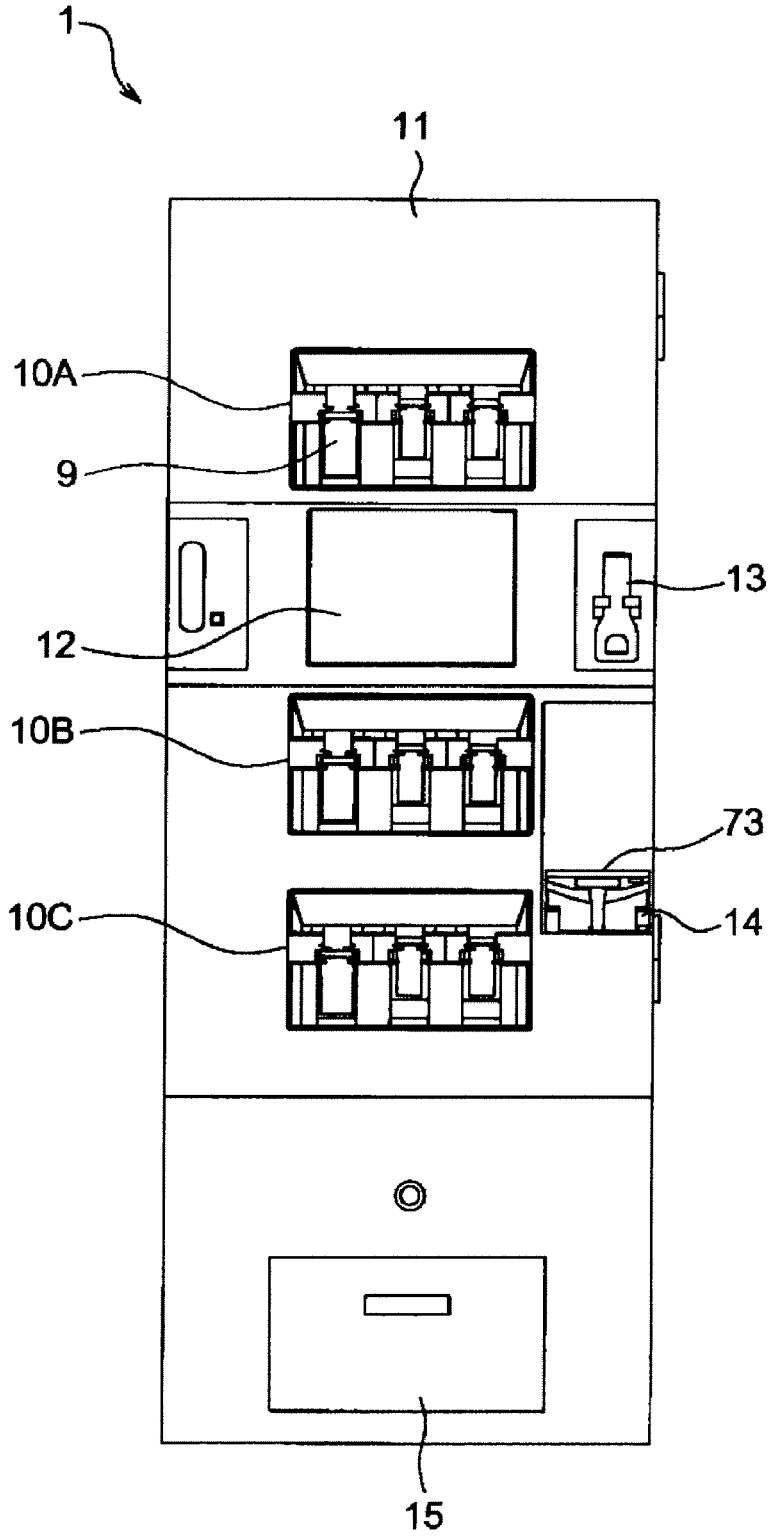
FIG. 3 is a front view of the tablet filling device shown in FIG. 1.
Figure 4:
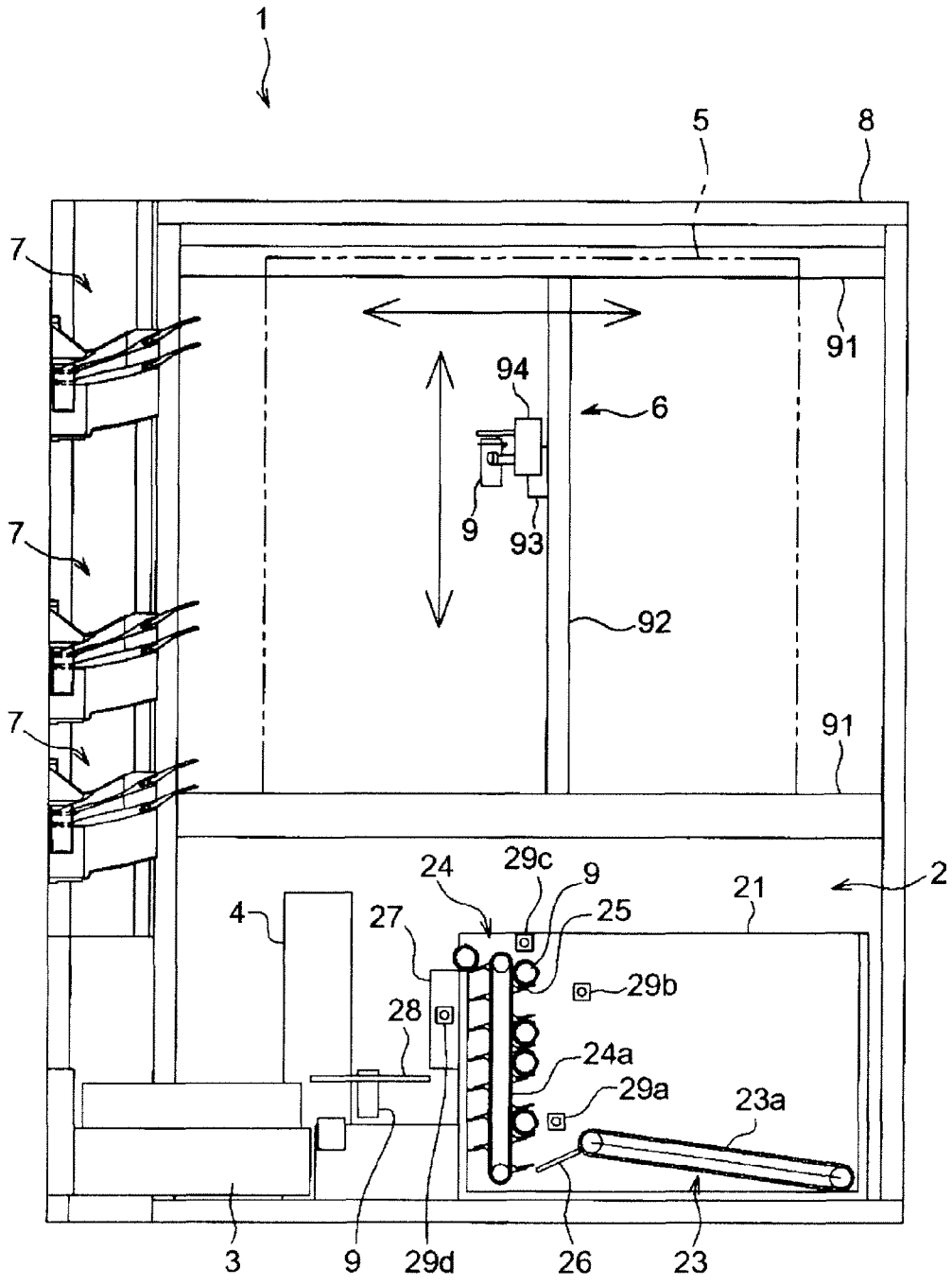
FIG. 4 is a side sectional view of the tablet filling device shown in FIG. 1.

FIGS. 1 to 4 illustrate a tablet filling device 1 according to an embodiment of the present invention. As shown in FIG. 4, the tablet filling device 1 includes a vial supplying unit 2, a labeling unit 3, a vial lifter 4, a tablet supplying unit 5, a conveying unit 6 and a discharging unit 7. The tablet filling device 1 has a device body 8. Herein, a face of the device body 8, at which discharging windows 10A, 10B and 10C for vials 9 are disposed, is referred to as a front.

A front door 11 is openably and closably provided in the front of the device body 8. The discharging windows 10A, 10B, 10C open along vertical three locations in the front door 11. Further, an operation panel 12 is provided between the upper discharging window 10A and the middle discharging window 10B. A barcode reader 13 is provided at the right side of the operation panel 12. An auxiliary mount 14 for replenishing or returning of tablets is provided below the barcode reader 13. A drawer for pulling out the labeling unit 3 is provided below the lower discharging window 10C.

<Vial Supplying Unit 2>

Figure 5:
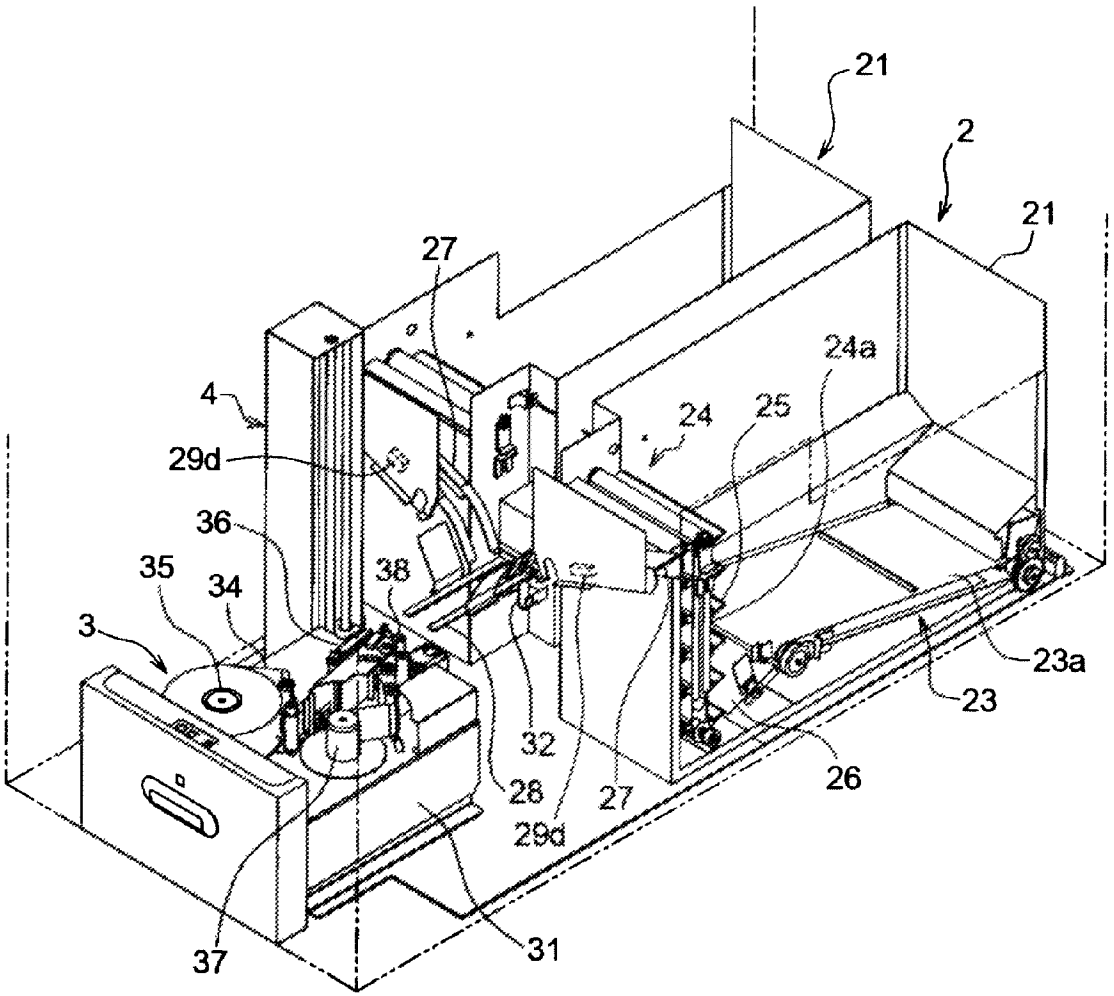
FIG. 5 is a perspective view of a vial supplying unit, a labeling unit and a vial lifter.

As shown in FIG. 5, the vial supplying unit 2 has stockers 21 of a rectangular box shape. The stockers are disposed at both lateral sides of a lower inside of the device body 8 when viewed from the front of the device body 8. Each of the stockers 21 randomly stocks the vials 9 of different sizes therein. The vials 9 may be replenished after opening doors 22 (see FIG. 1) provided at right and left sides of the device body 8. A conveyer 23, which includes an endless belt 23*a* to be driven in a traveling manner, is provided on an inside bottom of each of the stockers 21 as slanting upward toward the front of the device body 8. The conveyer 23 is configured to convey the vials 9 stocked in the stocker 21 toward the front. A removing device 24 is vertically disposed alongside an inner wall of a front side of the stocker 21. The removing device 24 includes an endless belt 24*a* to be driven in a traveling manner, to which paddles 25 are attached at regular intervals. The vial 9 is transversely held by the paddle 25 and can be removed along with ascent of the endless belt 24*a*. A guide plate 26, which guides the vials 9 having been conveyed by the conveyer 23 to the paddles 25 of the removing device 24, is provided between a front end of the conveyer 23 and a lower end of the removing device 24.

Figure 6:
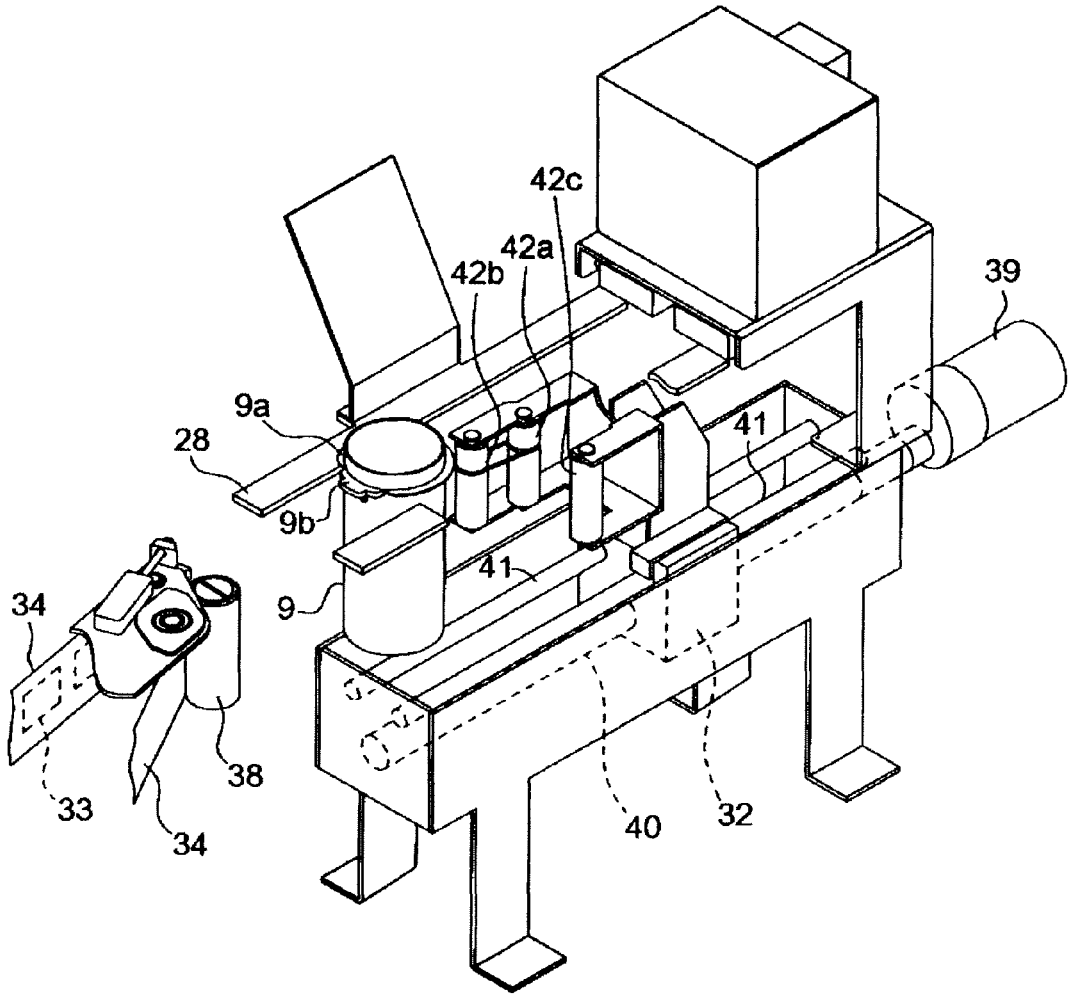
FIG. 6 is a perspective view of the labeling unit.

A pair of chutes 27 for sliding down the vial 9 having been removed from the stockers 21 by means of the removing device 24 and a pair of forks 28 for receiving and supporting the vial 9 having slid down from the pair of chutes 27 are provided at front outer walls of the stockers 21. The forks 28 are configured to vary a horizontal width therebetween so as to support any one of the vials 9 of different sizes by means of the well-known mechanism such as a rack-and-pinion mechanism. Further, as shown in FIG. 6, the vial 9 has a flange 9*a* around an outer periphery of its opening and a protruding piece 9*b* having a mechanism for locking a cap (not shown).

As shown in FIG. 4, the vial supplying unit 2 has the following sensors: a stockout sensor 29*a* at a lower inside of each of the stockers 21; an overfill sensor 29*b* at an upper inside of each of the stockers; a preparation detecting sensor 29*c* for detecting the vial 9 held by the paddle 25 in a topmost position; and a vial waiting sensor 29*d* for detecting the vial 9 staying stopped on the chute 27 by a stopper (not shown).

<Labeling Unit 3>

Figure 7:
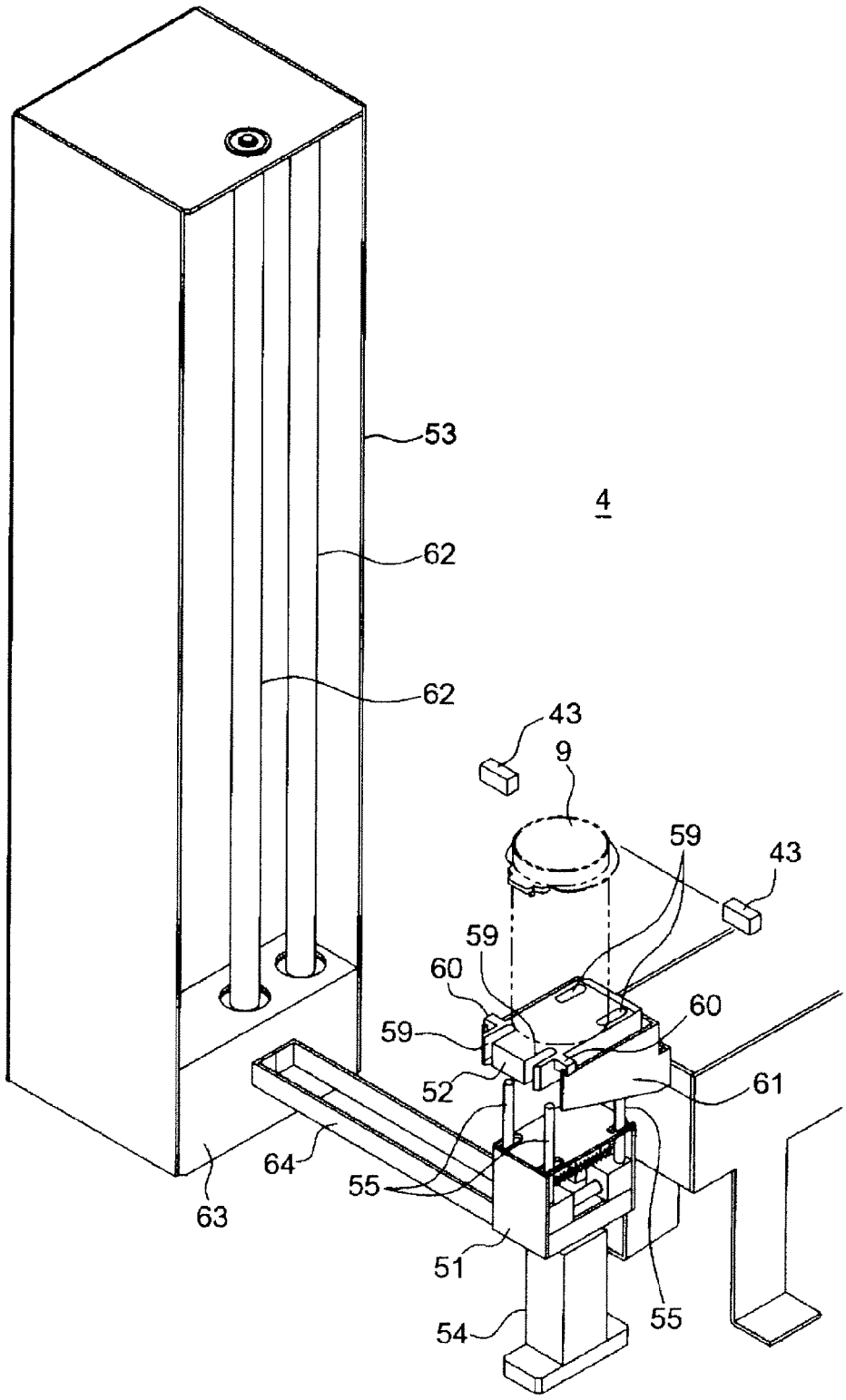
FIG. 7 is a perspective view of the vial lifter, showing that a lifting table stays in a standby position.

As shown in FIG. 5, the labeling unit 3 includes a label printer 31 and a pusher 32. As shown in FIG. 6, the label printer 31 uses a label tape 34, on which labels 33 to be applied on an outer periphery of the vial 9 are adhered at regular intervals. As shown in FIG. 5, the label printer 31 includes the following: a tape reel 35 around which the label tape 34 winds; a print head 36 for printing information such as a prescription number, a patient name and a medicine name on the label 33 of the label tape 34 fed from the tape reel 35; a take-up reel 37 for taking up the label tape 34 from which the label 33 is removed; and a driving roller 38 for rotating the vial 9. The label printer may comprise a conventional label printer. As shown in FIG. 6, the pusher 32 is movable along a guide rod 41 and parallel to the forks 28 by means of a ball screw 40 driven by a motor 39. The pusher 32 has three rollers 42*a*, 42*b*, 42*c*, which press the vial 9 supported by the forks 28 of the vial supplying unit 2 against the driving roller 38 of the label printer 31. As shown in FIG. 7, sensors 43 for detecting a position of the protruding piece 9*b* of the vial 9 of a large or small size are provided in the device body 8.

<Vial Lifter 4>

Figure 8:
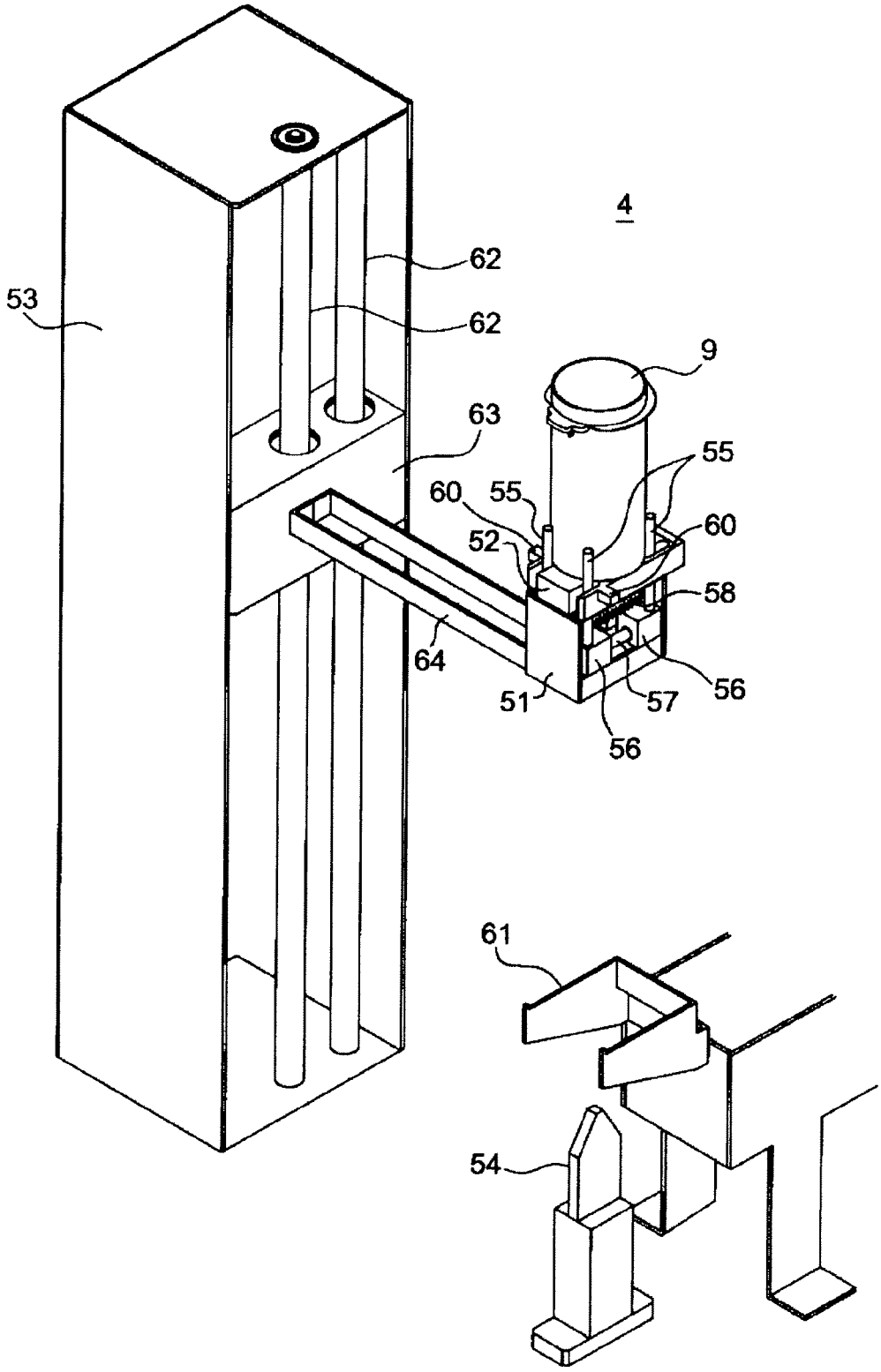
FIG. 8 is a perspective view of the vial lifter, showing that the lifting table is moving upward.
Figure 9:
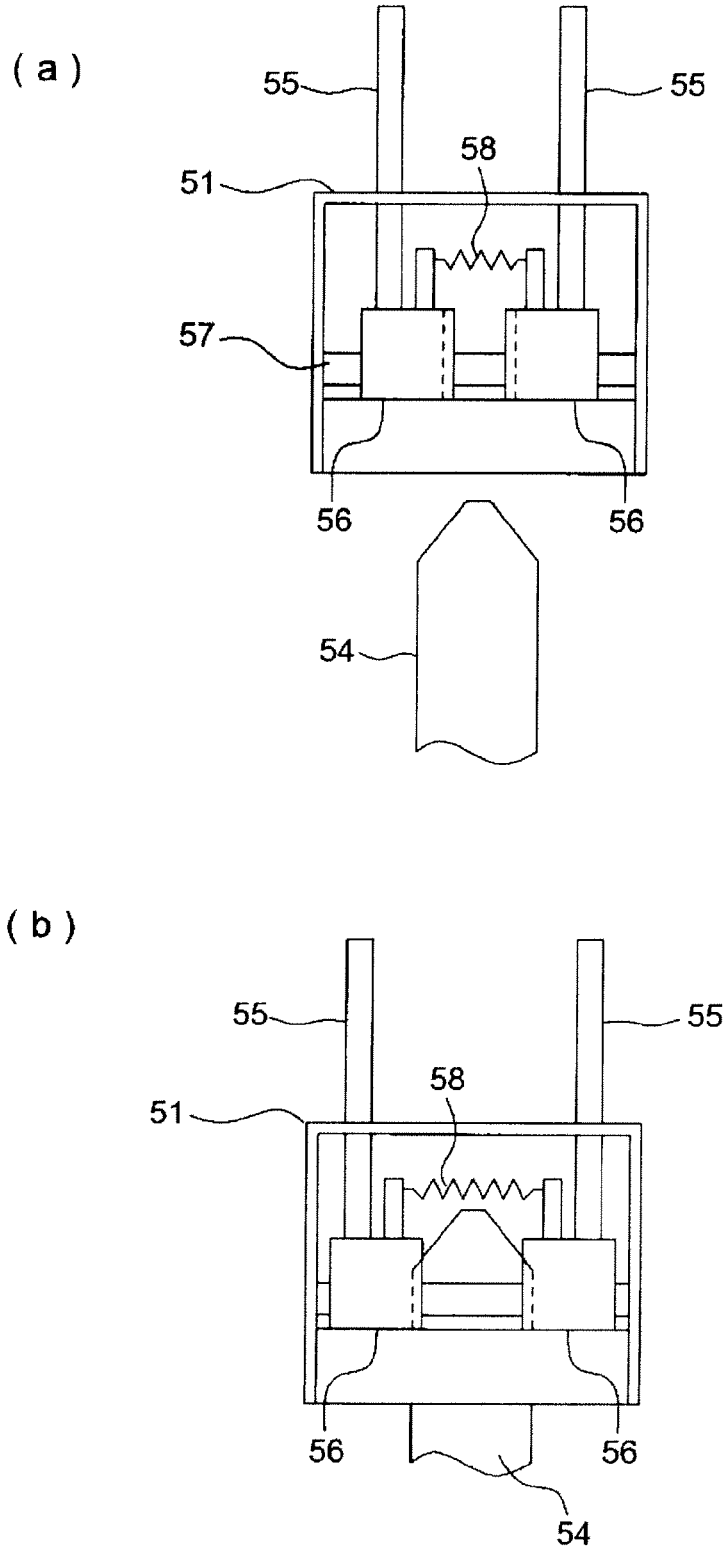
FIGS. 9(*a*) and 9(*b*) are side views showing operations of movable blocks for pins and a pin opening/closing bar.
Figure 10:
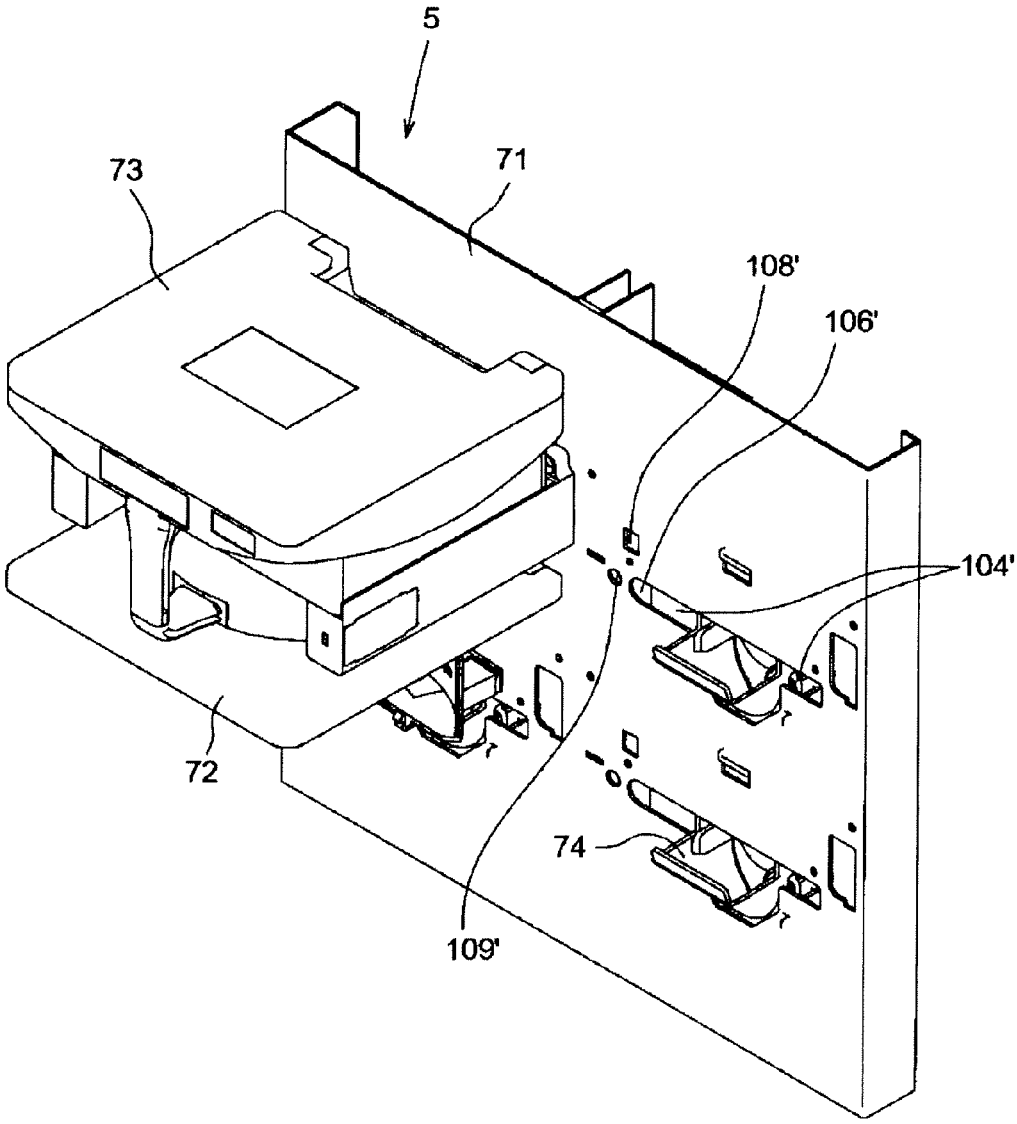
FIG. 10 is a perspective view of a tablet supplying unit.

As shown in FIGS. 7 to 9, the vial lifter 4 includes the following: a lifting table 51 for placing the vial 9 thereon; a supporting plate 52 disposed on the lifting table 51; a lifting mechanism 53 for lifting and lowering the lifting table 51 and the supporting plate 52; and a pin opening/closing bar 54.

The lifting table 51 has four pins 55 projecting upward for holding the outer periphery of the vial 9 on its top side. Bases of two opposite pins 55 are fixed to movable blocks 56. Two movable blocks 56 are movable in opposite directions toward and away from each other along a guide rod 57. The two movable blocks are biased in the direction toward each other by a spring 58. The supporting plate 52 has elongated cutouts 59 through which the four pins 55 pass. The supporting plate 52 has a plurality of lugs 60 at its outer periphery. The supporting plate is configured to be placed on a bracket 61 fixed to the device body 8 through the lugs 60. The lifting mechanism 53 has a lifting block 63 that is lifted and lowered along guide rods 62 by a belt driving device (not shown). The lifting table 51 is fixed to a distal end of an arm 64 that is provided at the lifting block 63. The pin opening/closing bar 54 is located below the lifting table 51 and is fixed to the device body 8. The pin opening/closing bar 54 engages and disengages from a space between the two movable blocks 56 of the lifting table 51 along with lifting and lowering movements of the lifting table 51 to thereby move the movable blocks 56 to open and close the four pins 55.

As the lifting table 51 is lowered by operation of the lifting mechanism 53 of the vial lifter 4, as shown in FIG. 7, the four pins 55 are pushed out and widened by the pin opening/closing bar 54 located below the lifting table 51 and is then moved in the direction away from the vial 9 against a biasing force of the springs 58. During the lowering movement of the lifting table 51, the supporting plate 52 stops by being hung up by the bracket 61, whereas the lifting table 51 continues to go down and stops at a bottommost position. As the lifting table 51 moves upward from the bottommost position, as shown in FIG. 8, the supporting plate 52 hung up by the bracket 61 is placed on the lifting table. Further, the four pins 55 are disengaged from the pin opening/closing bar 54, thereby pressing and holding the vial 9 placed on the supporting plate 52 under the biasing force of the springs 58. The lifting mechanism 53 conveys the vial 9 placed on the lifting table 51 from a labeling position to a delivery position of the conveying unit 6, which will be described below.

<Tablet Supplying Unit 5>

Figure 11:
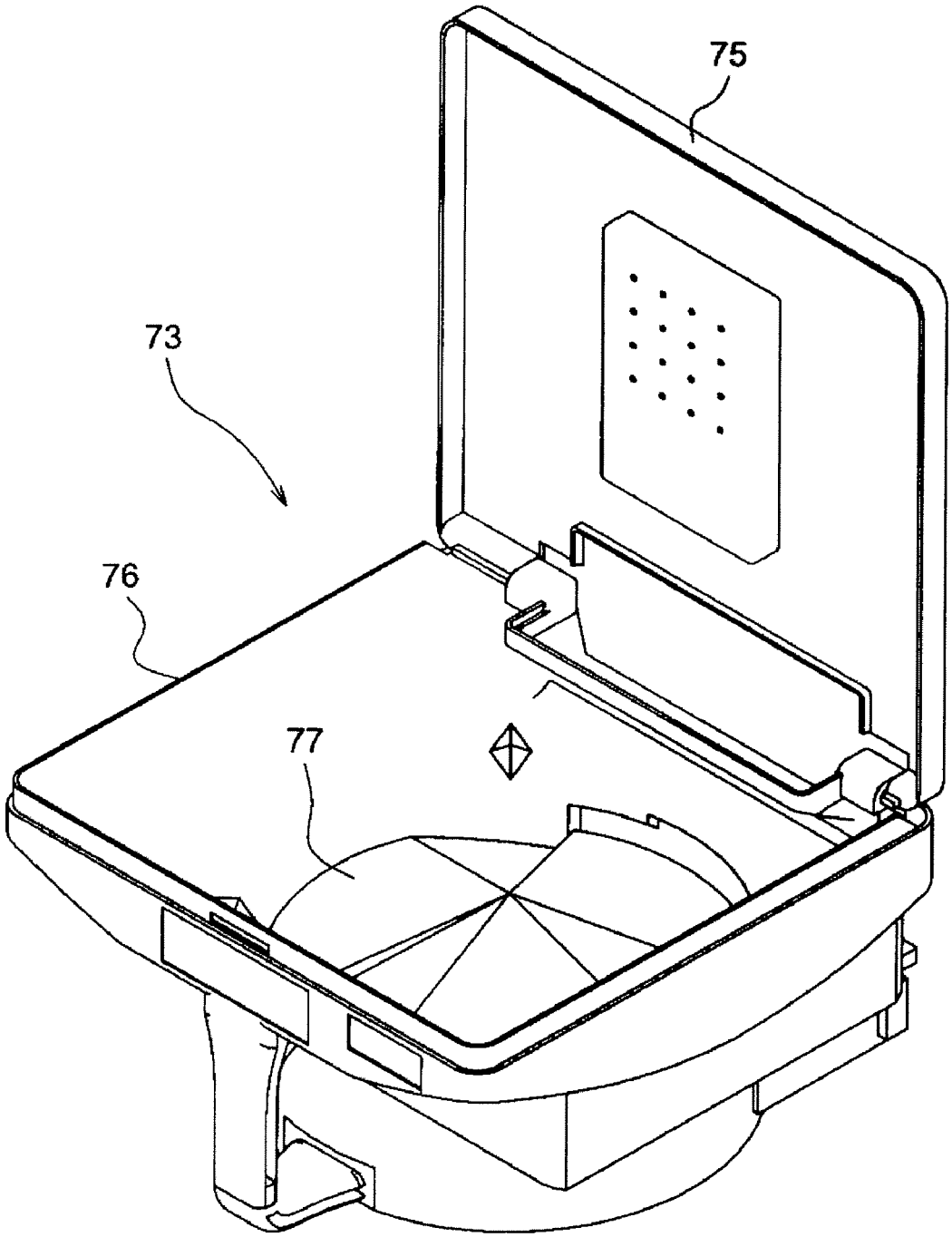
FIG. 11 is an upper perspective view of a tablet cassette.
Figure 12:
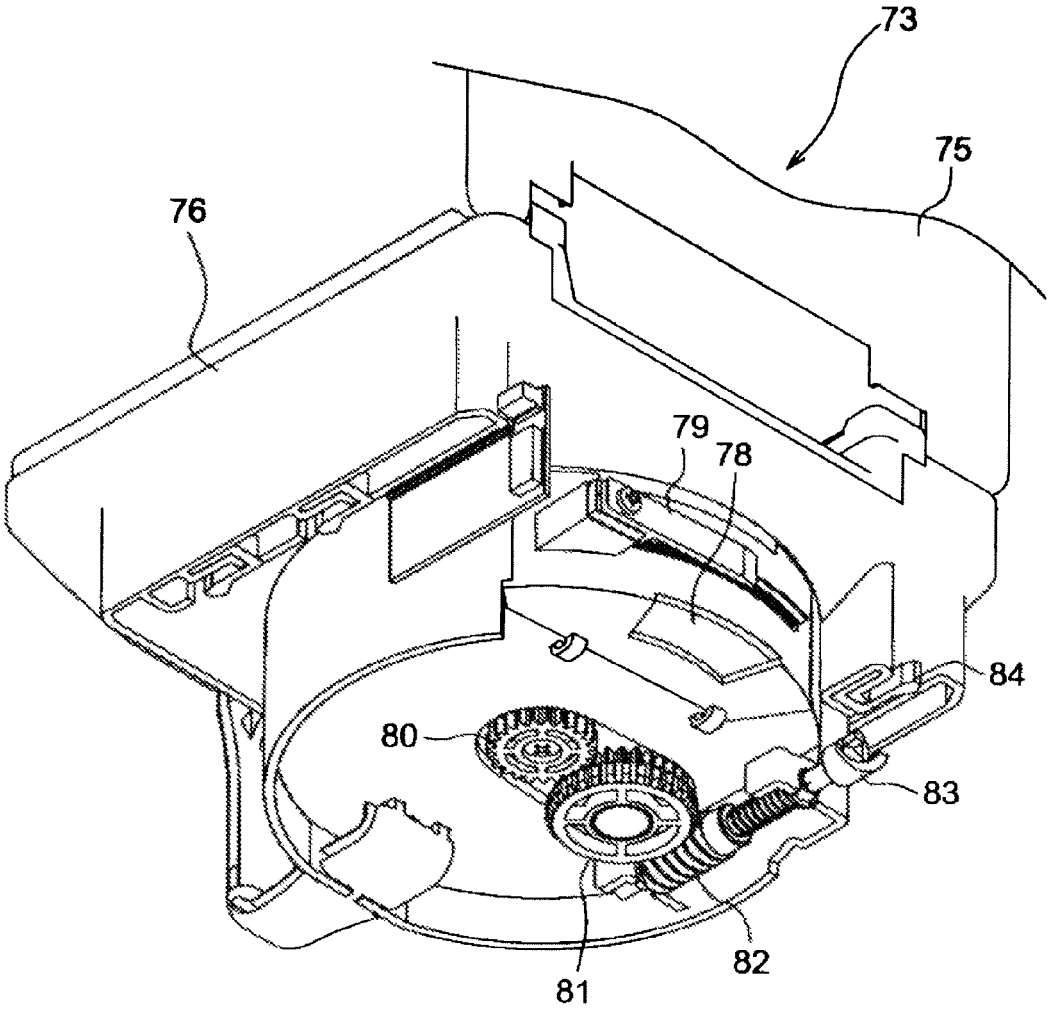
FIG. 12 is a lower perspective view of the tablet cassette.

The tablet supplying unit 5 includes a large number of tablet cassettes 73, which are detachably attached to attaching mounts 72 provided on supporting panels 71 disposed along both sides of the device body 8. Each of the supporting panels 71 has tablet outlets 74 that are positioned to correspond to the tablet cassettes 73, respectively. Each of the supporting panels further has sensor holes 104', driving shaft holes 106', protruding piece holes 108' and detection rod holes 109', in which count sensors 104, driving shafts 106, protruding pieces 108 and detecting rods 109 of an arm unit 94 described below are put, respectively. As shown in FIG. 11, the tablet cassette 73 includes a tablet container 76 with a lid 75 openably and closably attached thereto. A rotor 77 is rotatably attached to an inner bottom of the tablet container 76. The rotor 77 has pockets (not shown) for holding tablets at its outer periphery, which extend in an axial direction and are juxtaposed at regular intervals in a peripheral direction. As shown in FIG. 12, the tablet container 76 has a discharging hole 78 defined at its outer bottom and communicating with one of the pockets of the rotor 77. A partition member 79 is provided above the discharging hole 78 for partitioning the pocket of the rotor 77 and discharging a bottommost tablet among the tablets held in the pocket through the discharging hole 78. In a center of the outer bottom of the tablet container 76, a rotor gear 80 is coupled to a rotating shaft of the rotor 77 penetrating through the bottom of the tablet container 76. Further, an intermediate gear 81 meshed with the rotor gear 80 and a worm gear 82 meshed with the intermediate gear 81 are attached to the outer bottom of the tablet container 76. The worm gear 82 has an engaging receptacle 83, which engages an engaging portion 107 of a driving shaft 106 of the conveying unit 6 (which will be described below) to receive power therefrom, at its tip end. The tablet container 76 further has an engaging portion 84 adjacent to the engaging receptacle 83 at its back side.

<Conveying Unit 6>

As shown in FIG. 4, the conveying unit 6 is disposed between the tablet supplying units 5 arranged at the both sides of the device body. The conveying unit includes the following: first horizontal rails 91 fixed to an upper side and a lower side of the device body 8; a vertical rail 92 forward and backward movably mounted to the first horizontal rails 91; a second horizontal rail 93 vertically movably mounted on the vertical rail 92; and the arm unit 94 laterally movably mounted on the second horizontal rail 93.

Figure 13:
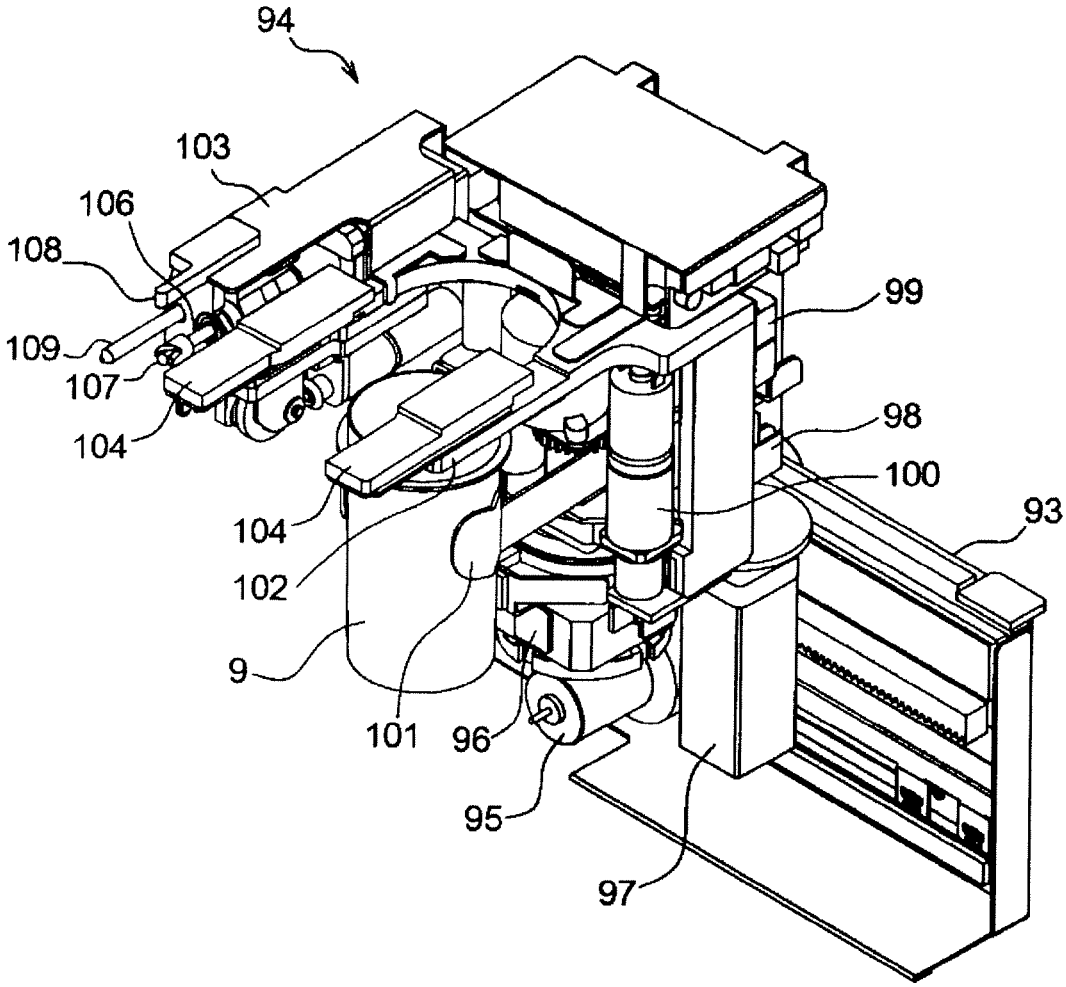
FIG. 13 is a perspective view of an arm unit of a conveying unit.
Figure 14:
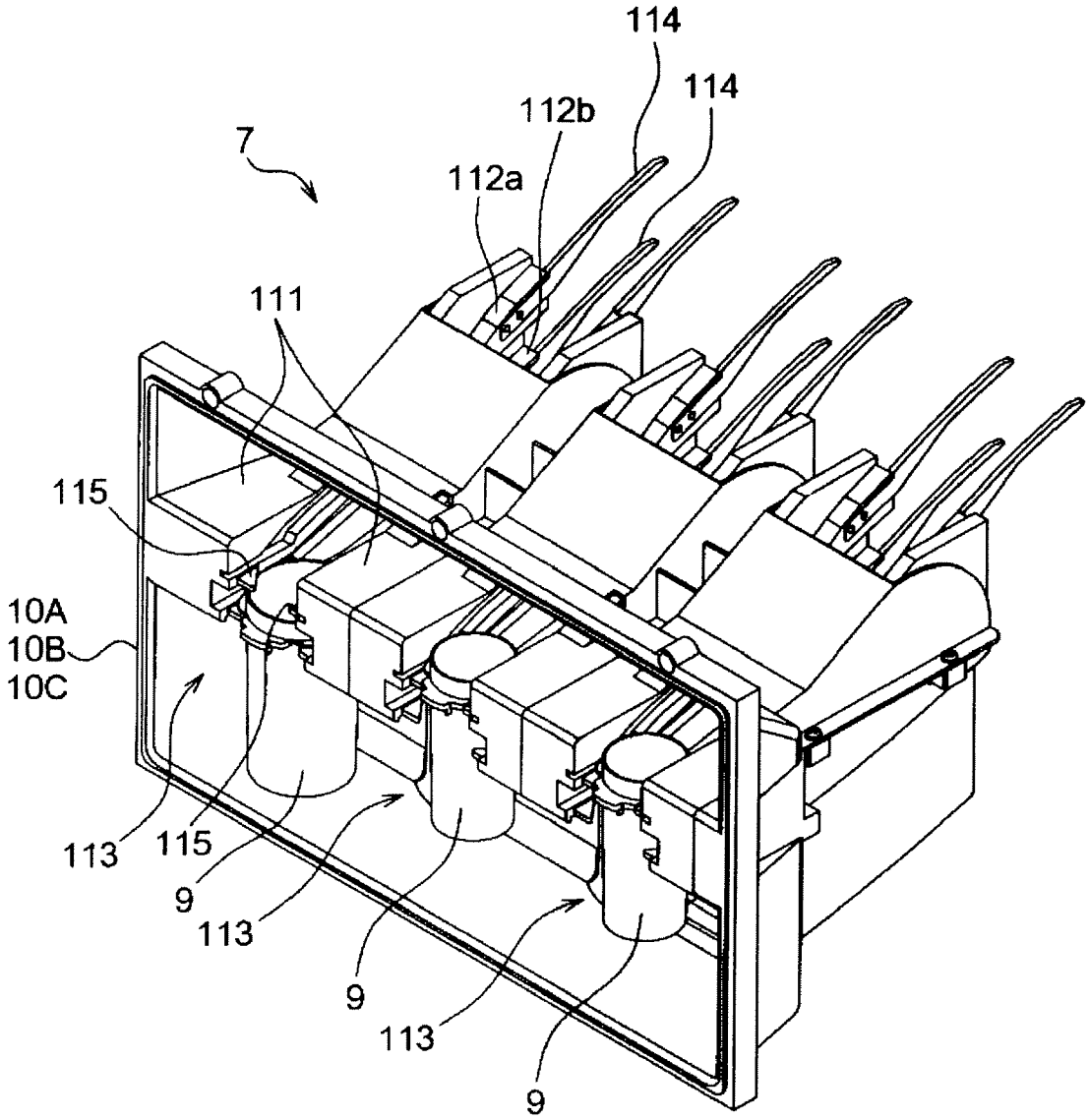
FIG. 14 is a perspective view of a discharging unit.

As shown in FIG. 13, the arm unit 94 includes the following: an orthogonal moving base 96 mounted on the second horizontal rail 93 to be moved by a motor 95; a pivoting base 98 mounted on the orthogonal moving base 96 to be pivoted by a motor 97; and a tilting base 99 mounted on the pivoting base 98 to be tilted by a motor (not shown). A pair of arms 101, which are openable and closable by operation of a motor 100 to grip and release the vial 9, are attached to the tilting base 99. A U-shaped sensor arm 102 and a driving arm 103 are provided in the pivoting base 98 above the arms 101. The count sensors 104 are attached to both distal ends of the U-shaped sensor arm 102 to count the number of the tablets discharged from the tablet cassette 73. The driving shaft 106, which is driven by a motor to rotate, is provided in the driving arm 103. The driving shaft 106 has the engaging portion 107, which engages the above-described engaging receptacle 83 of the worm gear 82 of the tablet cassette 73, at its tip end. Further, the protruding piece 108, which engages the engaging portion 84 of the tablet cassette 73 to position the arm unit 94 in a proper place, and the detection rod 109, which detects whether the arm unit 94 is positioned in the proper place, are attached to the driving arm 103.

<Discharging Unit 7>

The discharging unit 7 includes nine pairs of holding members 111, each of which bilaterally lies to makes one pair. Three pairs of the holding members 111 are disposed at each of the three discharging windows 10A, 10B, 10C. Two slopes 112*a*, 112*b*, which are juxtaposed vertically, are provided at one of the opposite sides in one pair of the holding members 111. Upper ends of the slopes are located within the device body 8 and lower ends of the slopes are located in the discharging window 10A, 10B, 10C, thereby forming an outlet 113. A guiding member 114 further extending obliquely upward is attached to the upper end of each of the slopes 112*a* and 112*b*. The guiding member 114 has a top face forming a slope that is continuous to the slope of the holding member 111. Stoppers 115 are attached to the lower ends of the slopes 112*a*, 112*b*, respectively. The stoppers 115 are configured to normally project toward each other by an biasing force of a spring (not shown) to catch the vial 9 sliding down the slopes 112*a*, 112*b*, and to retract against the biasing force of the spring to allow the vial 9 to pass therethrough when an operator removes the vial 9.

Figure 15:
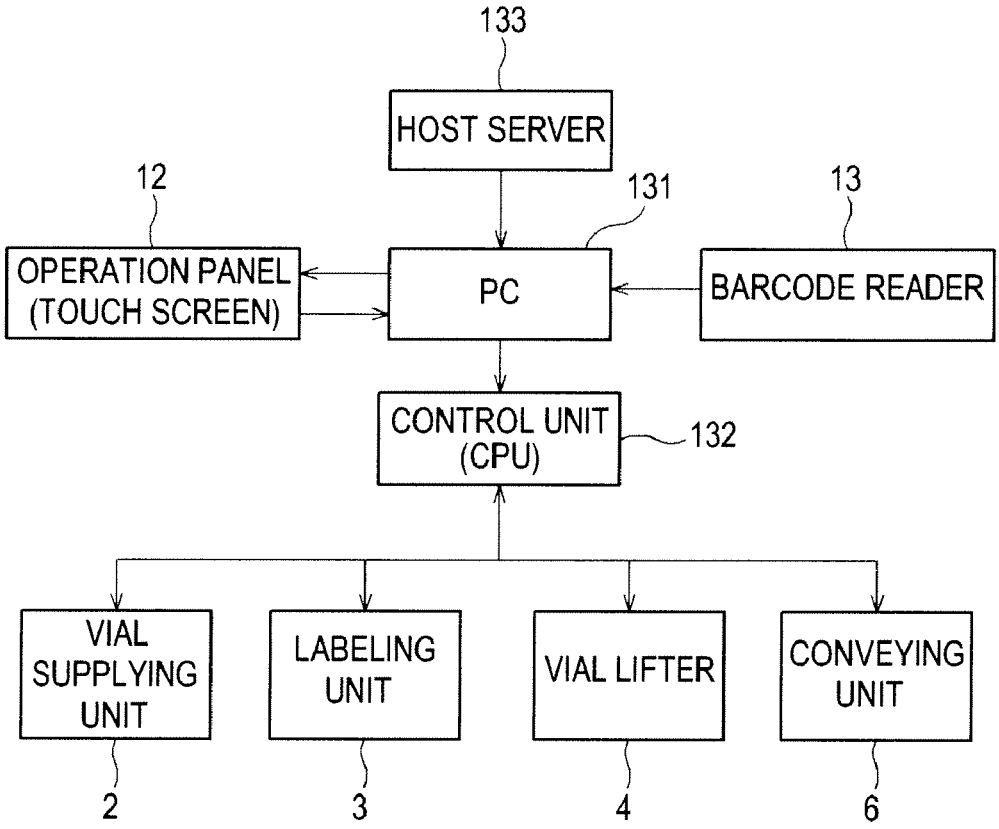
FIG. 15 is a block diagram of the tablet filling device.

FIG. 15 is a control block diagram of the tablet filling device 1 according to the present invention. The vial supplying unit 2, the labeling unit 3, the vial lifter 4, and the conveying unit 5 are controlled by a control unit 132 based on commands from a personal computer (PC) 131. Further, the personal computer 131 is managed by a host server 133. The personal computer 131 is configured to receive signals inputted from a touch screen of the operation panel 12 and to output display signals required for the operation panel 12. The personal computer 131 is further configured to receive read signals inputted from the barcode reader 13.

Operations of the tablet filling device 1 having the above-described configuration will now be described with reference to a flow chart illustrated in FIG. 16.

When a prescription data is received from the host server 133 at Step S1, the prescription data is processed to a dispensation data at Step S2. As to tablets, a vial order is given to the tablet filling device 1 at Step S3. As to injectable solutions, powdered medicines, heat tablets and the like, a dispensing order is given to respective devices at Step S4 and they are dispensed by the respective device or manually dispensed at Step S5. When the vial order is received, a proper vial 9 having a volume sufficient enough to accommodate the tablets is determined at Step S6, based on data of maximum filling quantity from the medicine master 134 of the personal computer 131. The medicine master 134 stores a maximum filling quantity of each tablet for a vial 9 according to data such as a shape, weight and volume of the tablet.

At Step S7, it is judged whether the determined vial 9 is of 20DR or 40DR. Where 40DR, it is judged at Step S8 whether the vial 9 of 40DR is out-of-stock based on a detection signal of the stockout sensor 29*a* of the stocker 21. When the vial 9 of 40DR is out-of-stock, a signal of error display (display indicating vial replenishment) is sent to the operation panel 12 at Step S9. As a result, a stockout warning indication is displayed on the operation panel 12 at Step S10.

Where the vial 9 is of 20DR at Step S7, it is judged at Step S11 whether the vial 9 of 20DR is out-of-stock based on the detection signal of the stockout sensor 29*a* of the stocker 21. When the vial 9 of 20DR is out-of-stock, it is further judged at Step S12 whether the alternative vial 9 of 40DR larger than that of 20DR is out-of-stock. When out-of-stock, the error display is ordered at Step S9 and then the stockout warning indication is displayed on the operation panel 12 at Step S10. When the alternative vial 9 of 40DR is not out-of-stock at Step S12, the previously determined size of the vial 9 is changed from 20DR to 40DR at Step S13. At Step S14, when the vial 9 of 40DR is not out-of-stock at Step S8, the size of the vial 9 is fixed as previously determined 40DR. Further, at Step S14, when the vial 9 of 20DR is not out-of-stock at Step S11, the size of the vial 9 is fixed as previously determined 20DR. Furthermore, at Step S14, when changed at Step S13, the size of the vial 9 is fixed as changed 40DR.

Figure 17:
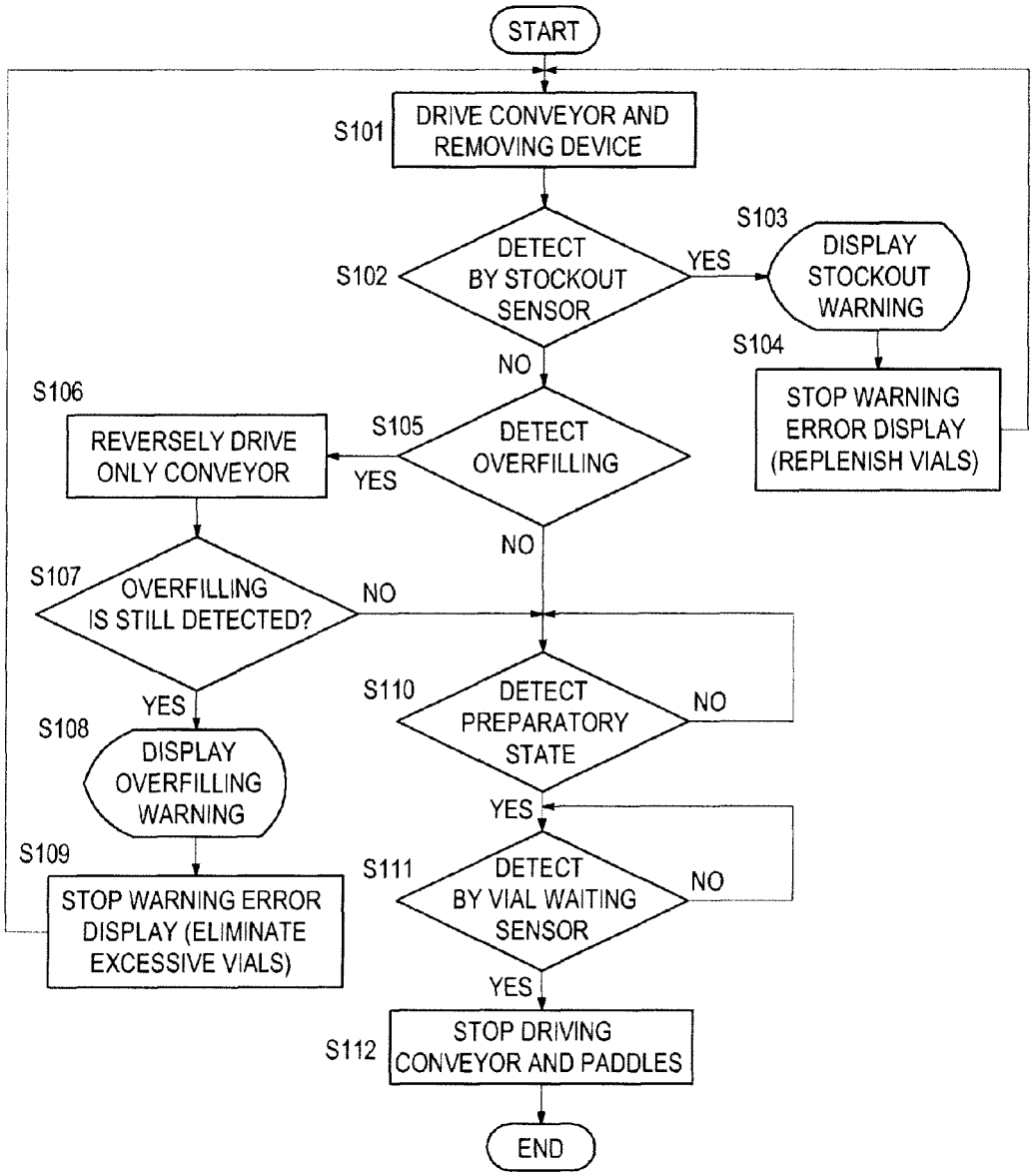
FIG. 17 is a flow chart showing operations of the vial supplying unit of the tablet filling device.

If the size of the vial 9 is fixed at Step S14 as described above, an operation of supplying the vial 9 starts at Step S15. As shown in FIG. 17, the conveyor 23 and the removing device 24 of the stocker 21, in which the vials 9 of the fixed size are accommodated, are driven at Step S101. Then, one of the vials 9 in the stocker 21 is removed by means of the paddle 25 of the removing device 24 and slides down the chute 27 to be placed on the forks 28. Further, the forks 28 are adjusted to have their gap correspond to the size of the vial 9. Thus, even if the vial 9 slides down the chute 27 with either its opening or bottom headed forward, the flange 9*a* is supported by the forks 28 with the opening facing upward.

During the operation of supplying the vial 9, it is detected once again at Step S102 whether the stockout sensor 29*a* detects the stockout of the vial 9. When out-of-stock, the error display is ordered at Step S103 and the stockout warning indication is displayed on the operation panel 12 at Step S104. When not out-of-stock, overfilling of the vials 9 (i.e., excessive supply) is detected at Step S105. The overfilling of the vials 9 is detected based on a detection signal of the overfill sensor 29*b* of the stocker 21. Where the vials 9 overfill, only the conveyor 23 is reversely driven at Step S106 to reduce the bulk of the vials 9 existing in the vicinity of the paddle 25. If the overfill is still detected at Step 107 after reversely driving the conveyor 23, then there is a possibility that two or more vials 9 are supplied, or that a superfluous load is applied to the paddle 25 to damage the paddle. Accordingly, an overfilling warning indication is displayed on the operation panel 12 at Step S108. When the overfilling is no longer detected by eliminating excessive vials 9, the warning error display stops at Step S109 and the operation returns to Step S101. If the overfilling is no longer detected at Step S107 by reversely driving the conveyor 23, then it is detected by the preparation detecting sensor 29*c* at Step S110 that the vial 9 is placed on the topmost paddle 25 to exist in the preparatory state. Further, it is detected by the vial waiting sensor 29*d* at Step S111 that the vial 9 is placed on the fork 28 and waits at the fork 28. If so detected, then driving the conveyor 23 and the removing device 24 is stopped at Step S112.

Figure 16:
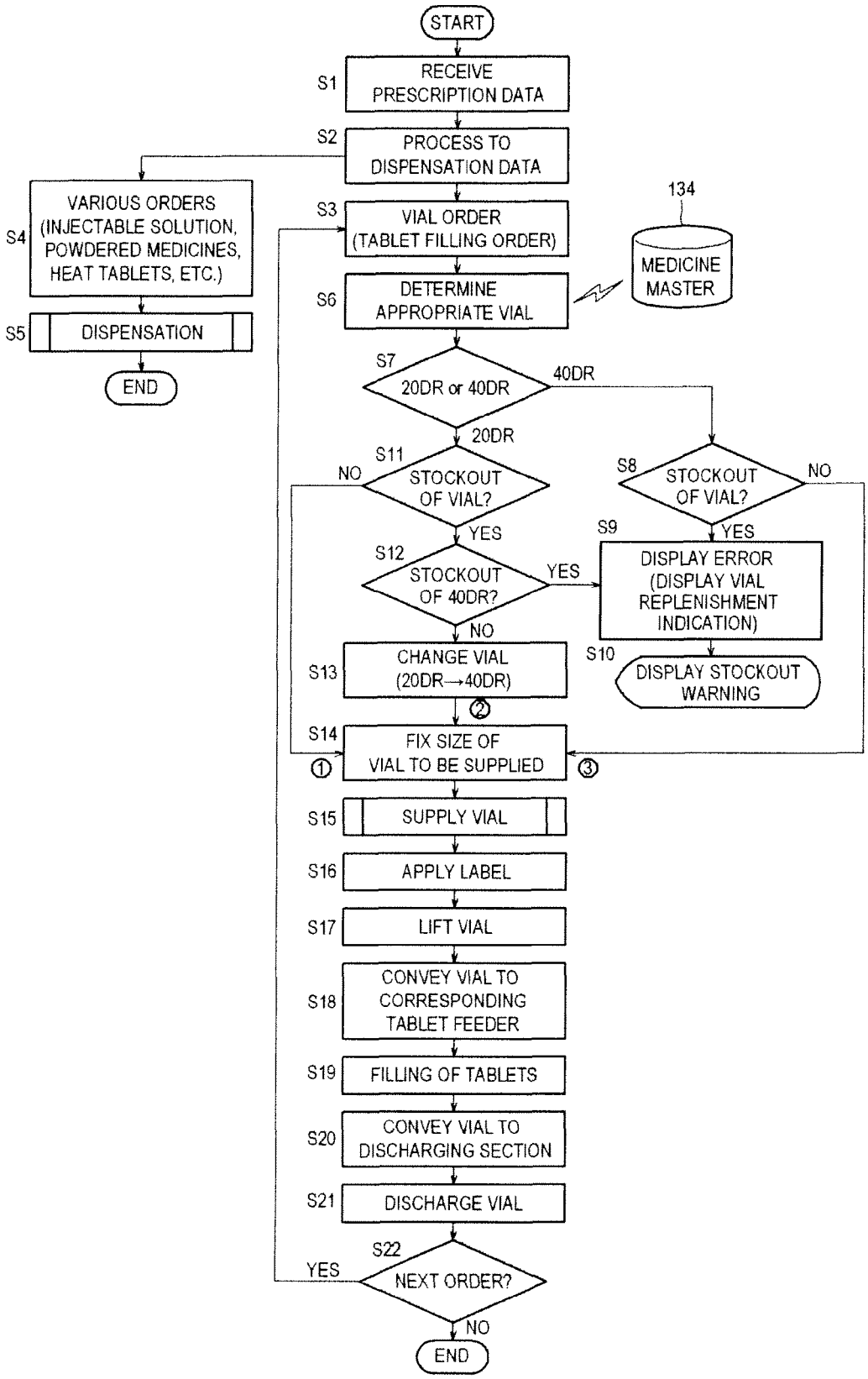
FIG. 16 is a flow chart showing operations of the tablet filling device.

When the vial supply operation is completed, an operation of applying the label 33 on the vial 9 is done at Step S16 of the flow chart illustrated in FIG. 16. First, the pusher 32 is driven to move the vial 9 supported by the forks 28 onto the supporting plate 52 of the vial lifter 4. Then, while the vial 9 is pushed against the driving roller 38 of the label printer 31 and is rotated, the label printer 31 is actuated. Thus, predetermined matters are printed on the label 33 of the label tape 34 as it passes through the print head 36. And, when the printed label 33 approaches the vial 9, it is removed from the label tape and is applied to the vial 9.

When the labeling operation is completed, an operation of lifting the vial 9 is done at Step S17 of the flow chart illustrated in FIG. 16. When the lifting table 51 is moved upward by means of the lifting mechanism 53, the pins 55 are inserted to the supporting plate 52 and the pin opening/closing bar 54 disengages from the movable blocks 56. Thus, the four pins 55 are moved by the biasing force of the springs 58 to grip the vial 9. As the lifting table 51 is further moved upward, the supporting plate 52 hung up by the bracket 61 is pushed up and the vial 9 is lifted up to a first delivery position of the conveying unit 6 and stops thereat. When the vial 9 is held by means of the conveying unit 6 at the first delivery position, the lifting table 51 is lowered. When the lifting table 51 comes near to a downward standby position, the pin opening/closing bar 54 engages the movable blocks 56, to which the four pins 55 are attached, to widen the space between the pins 55 against the biasing force of the springs 58. Then, the lifting table 51 waits so as to receive the next vial 9. During the downward movement of the lifting table 51, the supporting plate 52 is supported by the bracket 61 and only the lifting table 51 is lowered up to the standby position. In a prior art tablet filling device, a drive mechanism, which grips a vial such that the vial does not drop down during its upward movement, needs to be provided at a lifting table, thereby complicating the control and structure of the device. However, according to this embodiment, since the pin opening/closing bar 54 engages and disengages from the moving blocks 56 along with the lifting and lowering of the lifting table 51 to open and close the pins 55, a drive mechanism for opening and closing the pins such as a motor, a solenoid, etc. does not need to be provided at the lifting table 51, thereby providing a remarkably simple control and structure.

When the delivery operation associated with lifting of the vial 9 is completed, the conveying unit 6 is driven and then an operation of conveying the vial 9 to the tablet cassette 73 accommodating corresponding tablets is done at Step S18 of the flow chart illustrated in FIG. 16. First, the vertical rail 92 is forward and backward moved along the first horizontal rails 91 and the second horizontal rail 93 is vertically moved along the vertical rail 92, such that the arm unit 94 on the second horizontal rail 93 is brought into proximity to the vial 9 on the lifting table 51 and the arms 101 of the arm unit 94 grips the vial 9. Then, the vial 9 gripped by the arm unit 94 is brought into proximity to the tablet cassette 73 accommodating the corresponding tablets. Tilting of the tilting base 99 tilts the vial 9, thereby positioning the opening of the vial obliquely below the tablet outlet 74. As the arm unit 94 is advanced, the count sensor 104 is inserted to the sensor hole 104' of the supporting panel 71, and the detection rod 109 is inserted to the detection rod hole 109' of the supporting panel 71, and the protruding piece 108 is inserted to the protruding piece hole 108' of the supporting panel 71 to engage the engaging portion 84 of the tablet cassette 73, and the engaging portion 107 of the driving shaft 106 is inserted to the driving shaft hole 106' of the supporting panel 71 to engage the engaging receptacle 83 of the tablet cassette 73.

When the movement of the vial 9 is completed, an operation of accommodating the tablets is done at Step S19. As the motor 105 of the arm unit 94 is driven, the rotor 77 of the tablet cassette 73 rotates via the driving shaft 106, the worm gear 82, the intermediate gear 81, and the rotor gear 80. Thus, the tablets accommodated in the tablet container 76 and held in the pocket are accommodated by the vial 9 one by one from the discharging hole 78 through the tablet outlet 74 of the supporting panel 71. The tablets passing through the tablet outlet 74 are detected by the count sensor 104. If the vial 9 accommodates a predetermined number of tablets, then the vial is vertically held by returning the tilting base 99 to its horizontal state.

When accommodating the tablets is completed, at Step S20, the conveying unit 6 is driven to convey the vial 9 filled with the tablets to the discharging unit 7. In this case, the vial 9 is allowed to be positioned above the guiding members 114 of the holding members 111 of one of the outlets 113, in which the previously discharged vial 9 is not held. Further, it is judged whether a vial is held in the outlet 113 or not by an output signal from a vial detection sensor (not shown) disposed adjacent to the lower ends of the slopes 112*a*, 112*b*. Furthermore, the vial 9 of a small size is allowed to be positioned above the upper guiding members 114, while the vial 9 of a large size is allowed to be positioned above the lower guiding members 114.

When the movement of the vial is completed, at Step S21, the arms 101 of the arm unit 94 are opened to place the flange 9*a* of the vial 9 onto the guiding members 114 of the discharging unit 7. Thus, the vial 9 slides down along the slope 112*a* or 112*b* of a pair of the holding members 111 to be held in the outlet 113. Then, an operator can remove the vial 9.

The invention claimed is:

1. A tablet filling device for removing a vial from a stocker accommodating a large number of vials according to a prescription data, dispensing tablets into the vial to fill the vial, and discharging the vial filled with the tablets, wherein the stocker includes:

a vial removing device configured to scoop the vial accommodated in the stocker upward to remove the vial;

a vial conveying device configured to convey the vial toward the vial removing device; and a means configured to detect overfilling of the vial in the stocker, wherein the vial conveying device includes a belt conveyor inclined upward toward the vial removing device, and wherein when the means detects the overfilling of the vial, the vial conveying device is reversely driven.

2. The tablet filling device of claim 1, wherein the vial removing device includes a belt conveyor wherein paddles are attached to an endless belt at regular intervals.

3. The tablet filling device of claim 1, wherein the stocker further includes a guide plate between a front end of the vial conveying device and a lower end of the vial removing device, the guide plate being configured to guide the vial conveyed by the vial conveying device to the paddle of the vial removing device.

4. The tablet filling device of claim 1, wherein the stocker further includes a jam detecting means configured to detect the jam of the vial.

* * * * *